United States Patent [19]

Dakin et al.

[11] 4,090,810

[45] May 23, 1978

[54] LIQUID-COOLED TURBINE BUCKET WITH ENHANCED HEAT TRANSFER PERFORMANCE

[75] Inventors: James T. Dakin, Schenectady; Kenneth A. Darrow, Sprakers; Robert K. Alff, Ballston Lake, all of N.Y.

[73] Assignee: General Electric Company, Schenectady, N.Y.

[21] Appl. No.: 780,292

[22] Filed: Mar. 23, 1977

[51] Int. Cl.[2] ..... F01D 5/18

[52] U.S. Cl. ..... 416/97 R; 416/96 R

[58] Field of Search ..... 416/96 R, 96 A, 97 R, 416/97 A, 95

[56] References Cited

U.S. PATENT DOCUMENTS

| | | | |
|---|---|---|---|
| 3,619,076 | 11/1971 | Kydd | 416/95 X |
| 3,628,880 | 12/1971 | Smuland et al. | 416/97 X |
| 3,804,551 | 4/1974 | Moore | 416/97 |
| 3,816,022 | 6/1974 | Day | 416/95 X |
| 3,819,295 | 6/1974 | Hauser et al. | 416/97 |
| 3,856,433 | 12/1974 | Grondahl et al. | 416/97 |
| 4,017,210 | 4/1977 | Darrow | 416/95 X |

FOREIGN PATENT DOCUMENTS

| | | | |
|---|---|---|---|
| 497,230 | 10/1953 | Canada | 416/96 |
| 76,797 | 12/1953 | Denmark | 416/96 A |

*Primary Examiner*—Everette A. Powell, Jr.
*Attorney, Agent, or Firm*—L. I. MaLossi; J. T. Cohen; M. Synder

[57] ABSTRACT

Individual coolant passages in the airfoil portion of a liquid-cooled turbine bucket are each provided with a plurality of spanning elements spaced along, affixed in and extending across each passage whereby the main flow of liquid coolant moving in each such individual passage during turbine operation under the influence of centrifugal force is broken up. Each spanning element has one end thereof approximately centered in the region of the passage at that station therealong, which will be the most rearwardly disposed during rotation of the bucket in operation. In the embodiment described the spanning elements are cylindrical pins of circular cross-section disposed generally parallel to each other.

6 Claims, 3 Drawing Figures

LIQUID-COOLED TURBINE BUCKET WITH ENHANCED HEAT TRANSFER PERFORMANCE

BACKGROUND OF THE INVENTION

General teachings for the open-circuit liquid cooling of gas turbine vanes are set forth in U.S. Pat. No. 3,446,481 — Kydd: U.S. Pat. No. 3,619,076 — Kydd; U.S. Pat. No. 3,658,439 — Kydd; U.S. Pat. No. 3,816,022 — Day; and U.S. Pat. No. 3,856,433 — Grondahl et al., for example. In these patents, the cooling of the vanes, or buckets, is accomplished by means of a large number of spanwise-extending subsurface cooling passages.

The invention described and claimed herein is applicable in those constructions of liquid cooled buckets wherein the coolant passages are cylindrical in configuration. Thus, for example, preformed tubes employed as coolant passages preferably form a setting for the use of the instant invention. However, the concept of employing preformed tubes as subsurface coolant passages in turbine buckets, per se, as well as particular arrangements for incorporating such tubes in the bucket construction are the invention of other(s). Thus, the use of preformed tubes set in a copper matrix is shown in U.S. patent application Ser. No. 749,719 — Anderson, filed Dec. 13, 1976, and assigned to the assignee of the instant invention.

Tests made on open-circuit water cooled buckets with the axis of each coolant passage oriented approximately perpendicular to the turbine axis of rotation have established that under preferred conditions of operation (e.g., rate of water input, rotating speed, temperature of motive fluid, etc.) the water travels in a thin film through each passage. The water film is pulled through each channel by centrifugal force, achieving high radial velocity. At the same time, the film experiences a strong Coriolis force, which, at operational rates of cooling water supply, pushes the film into a limited area extending along the length of the coolant passage disposed the most rearwardly as the coolant passage is rotated.

When this occurs, the liquid film covers but a small fraction of the surface area of the coolant passage and the cooling capacity of the liquid flow is reduced. For a given heat flow into each coolant passage, or channel, this limited cooling area results in a higher coolant channel surface temperature and this in turn results in a higher bucket skin temperature and shortened bucket life. It would be most desirable to increase the effective cooling area within each coolant passage at any given rate of liquid coolant flow whereby the bucket skin temperature can be reduced and the cycle fatigue life extended.

The invention described and claimed in U.S. patent applications Ser. No. 743,272 — Kydd, filed Nov. 19, 1976, and Ser. No. 743,271 — Dakin et al., filed Nov. 19, 1976 (both assigned to the assignee of the instant invention) are directed to this same problem. In the Kydd application means (e.g., raised or recessed helical configurations) are provided within individual coolant passages for providing a swirling motion to the liquid coolant. In this manner the liquid coolant is subjected during operation to a first centrifugal force acting in the radial direction, the Coriolis force and a second centrifugal force acting about an axis extending in the general direction taken by the coolant passage.

In the Dakin et al. application, cylindrically-shaped coolant passages for liquid-cooled turbine buckets are converted into at least two helical sub-passageways by flow splitting means introduced into individual coolant passages and fixed in place as by brazing or tight mechanical fit. In addition each flow splitting, or flow modifying, means is provided with means disposed therealong for interrupting the liquid flow in each helical sub-passageway.

Various vortex flow promoters in single phase stationary systems have been described in an article by A. E. Bergles in *Progress in Heat and Mass Transfer,* Volume I, Edited by V. Grigull and E. Hahne [Pergamon Press, 1969]. In stationary systems the cooling fluid is forced through a channel by a pressure drop and the vortex promotion is accomplished at the expense of increased pump power. No discussion or guidance is provided therein of any solution to the problem of increasing the effective cooling area within coolant passages in a rotating system.

DESCRIPTION OF THE INVENTION

Individual coolant passages in the airfoil portion of a liquid-cooled turbine bucket are each provided with a plurality of spanning elements spaced along, affixed in and extending across each passage whereby the main flow of liquid coolant moving in each such individual passage during turbine operation under the influence of centrifugal force is broken up. Each spanning element has one end thereof approximately centered in the region of the passage at that station therealong, which will be the most rearwardly disposed during rotation of the bucket in operation.

BRIEF DESCRIPTION OF THE DRAWING

The features of this invention believed to be novel and unobvious over the prior art are set forth with particularity in the appended claims. The invention itself, however, as to the organization, method of operation and objects and advantages thereof, may best be understood by reference to the following description taken in conjunction with the accompanying drawing wherein:

MANNER AND PROCESS OF MAKING AND USING THE INVENTION

Figure 1:
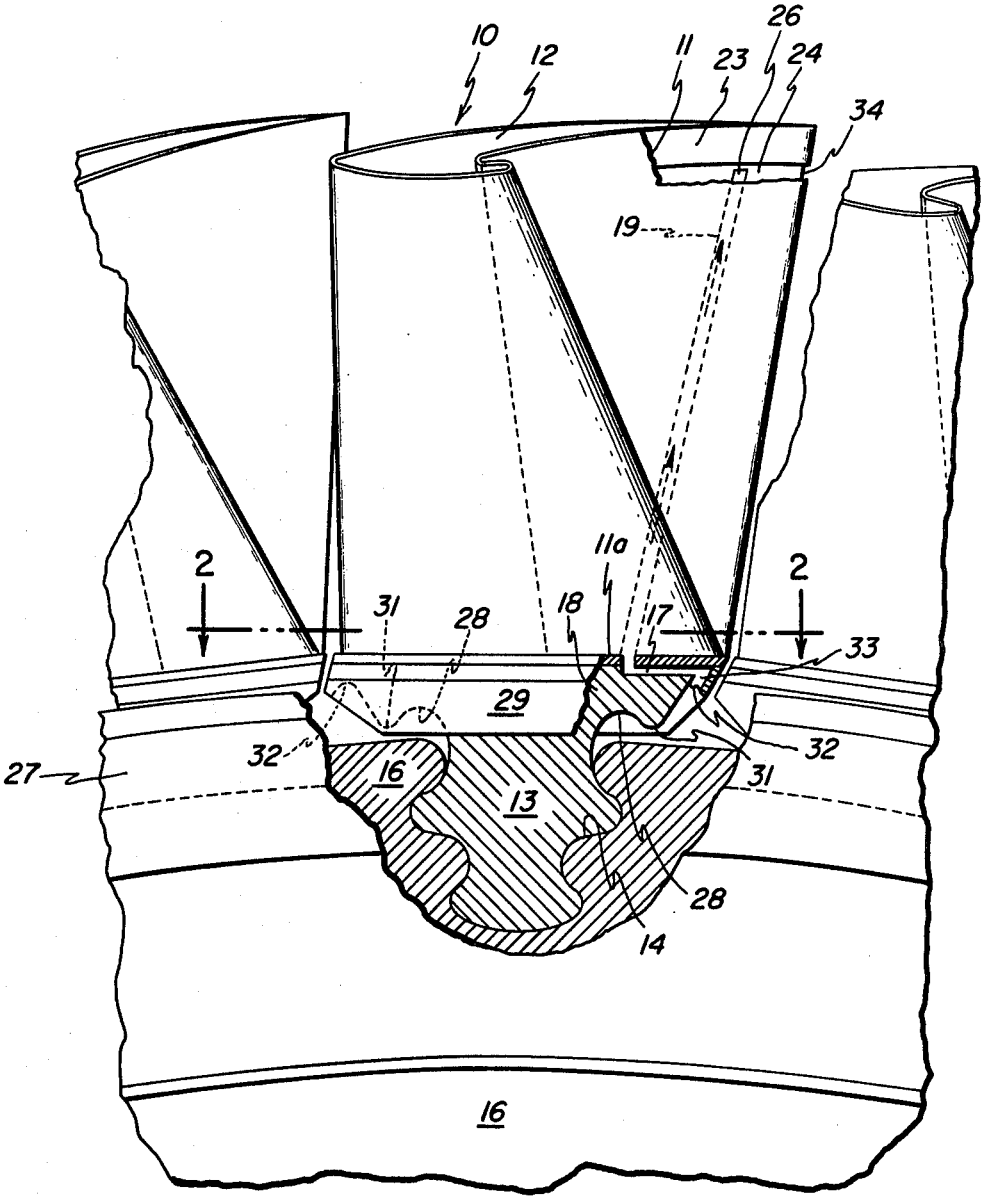
FIG. 1 is a view partially in section and partially cut away showing root, platform and airfoil-shaped portions of a liquid-cooled turbine bucket.
Figure 2:
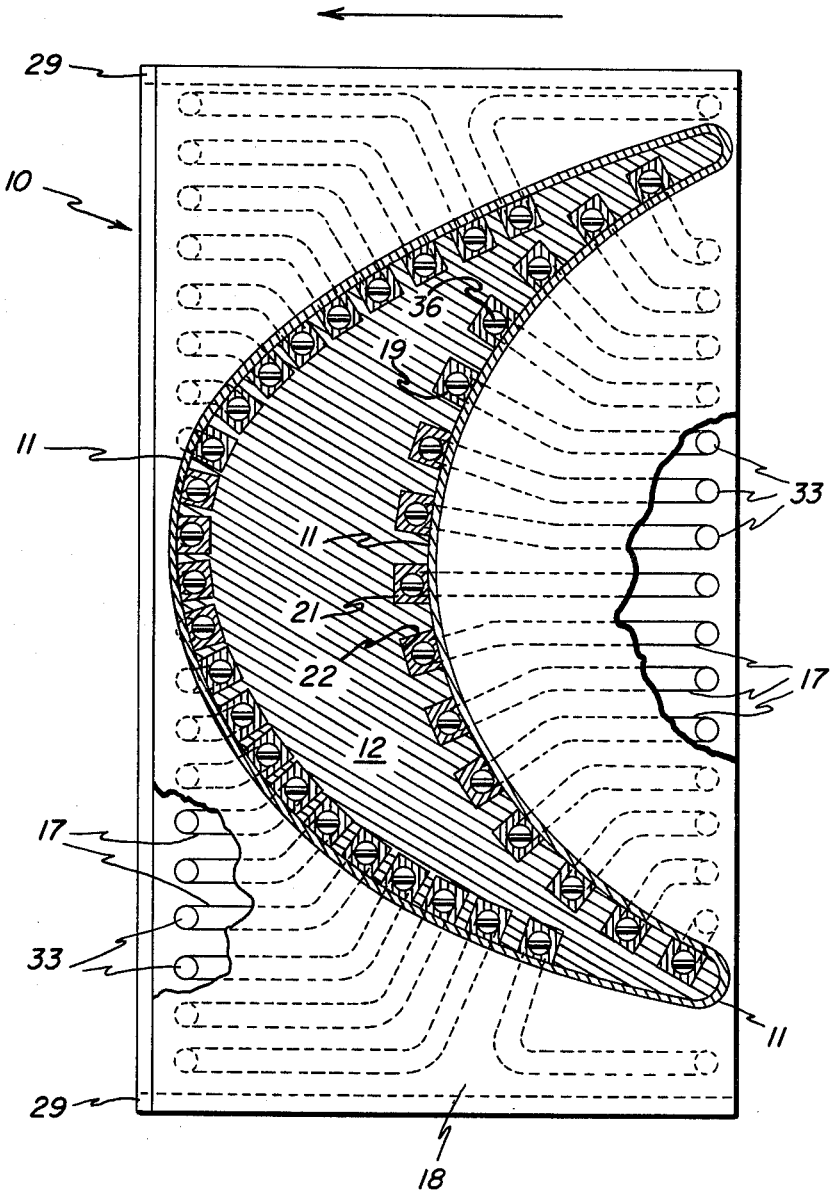
FIG. 2 is a view taken on line 2—2 of FIG. 1 with the platform skin removed in part.

The particular type of bucket construction shown in FIGS. 1 and 2 and described herein is merely exemplary and the invention is broadly applicable to open-circuit liquid-cooled turbine buckets equipped with sub-surface coolant passages of substantially circular transverse cross-section.

The turbine bucket 10 shown consists of skin 11, 11*a*, preferably of a heat- and wear-resistant material, affixed to a unitary bucket core 12 (i.e., root/platform/airfoil). Root portion 13, as shown, is formed in the conventional dovetail configuration by which bucket 10 is retained in slot 14 of wheel rim 16. Each groove 17 recessed in the surface of platform portion 18 is connected to and in flow communication with tube member 19 set in a metallic matrix 21 of high thermal conductivity in a recess, e.g., slot 22 in the surface of airfoil portion 23 of core 12. The airfoil portion 23 together with skin 11 comprises the airfoil portion of bucket 10. If desired, of course, sub-surface coolant passages 19 may be in the form of preformed tubes set into recessed grooves in skin 11. The general arrangement of coolant passages recessed in the airfoil skin is shown in U.S. Pat. No. 3,619,076 referred to hereinabove. As has been previously stated, the use of and arrangement of preformed tubes as coolant passages, per se, is the invention of another.

Liquid coolant is conducted through the coolant passages at a substantially uniform distance from the exterior surface of bucket 10. At the radially outer ends of the coolant passages 19 on the pressure side of bucket 10, these passages are in flow communication with, and terminate at, manifold 24 recessed into airfoil portion 23. On the suction side of bucket 10 the coolant passages, or channels, are in flow communication with, and terminate at, a similar manifold (not shown) recessed into airfoil portion 23. Near the trailing edge of bucket 10 a cross-over conduit (opening shown at 26) connects the manifold on the suction side with manifold 24. Open-circuit cooling is accomplished by spraying cooling liquid (usually water) at low pressure in a generally radially outward direction from nozzles (not shown) mounted on each side of the rotor disk. The coolant is received in an annular gutter, not shown in detail, formed in annular ring member 27, this ring member and the flow of coolant to and from the gutter is more completely described in the aforementioned Grondahl et al. patent, incorporated by reference.

Liquid coolant received in the gutters, is directed through feed holes (not shown) interconnecting the gutters with reservoirs 28, each of which extends in the direction parallel to the axis of rotation of the turbine disk.

The liquid coolant accumulates to fill each reservoir 18 (the ends thereof being closed by means of a pair of cover plates 29). As liquid coolant continues to reach each reservoir 28, the excess discharges over the crest of weir 31 along the length thereof and is thereby metered to the one side or the other of bucket 10.

Coolant that has traversed a given weir crest 31 continues in the generally radial direction to enter longitudinally-extending platform gutter 32 as a film-like distribution, passing thereafter through the coolant channel feed holes 33. Coolant passes from holes 33 to manifold 24 (and suction manifold, not shown) via platform and vane coolant passages.

As the coolant traverses the sub-surfaces of the platform portion and of the airfoil portion, these portions are kept cool with a quantity of the coolant being converted to the gaseous or vapor state as it absorbs heat, this quantity depending upon the relative amounts of coolant employed and heat encountered. The vapor or gas and any remaining liquid coolant exit from the manifold 24 via opening 34, preferably to enter a collection slot (not shown) formed in the casing for the eventual recirculation or disposal of the ejected liquid.

The amount of coolant admitted to the system for transit through the coolant passages may be varied and in those instances in which minimum coolant flow and high heat flux prevail, objectionable dry-out of the coolant passages may be encountered.

Figure 3:
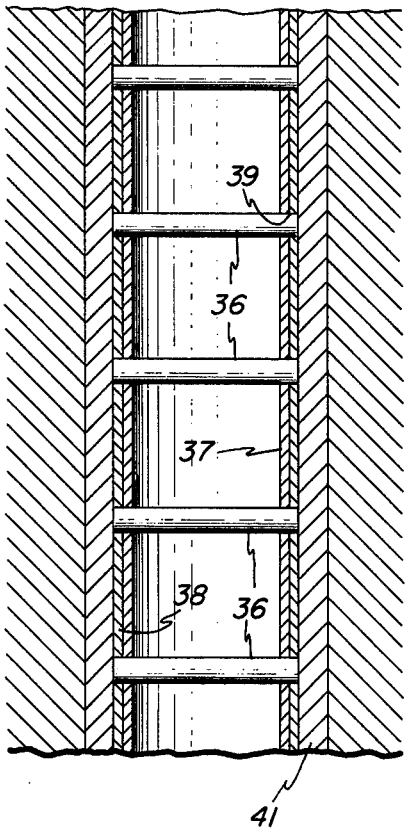
FIG. 3 is a longitudinal section taken along any of the coolant passages of FIG. 2.

In the practice of this invention (as illustrated generally in FIGS. 2 and 3) the interiors of all, or selected coolant passages 19 in a liquid-cooled turbine bucket 10 are provided with a series of elements 36 fixedly spaced therealong and extending across the open channel (but not necessarily diametrically thereof). It is, however, important that one end of each element 36, e.g., a pin, intersect the wall of passage 19 in the region of the coolant passage wall at that location, or station, along the given coolant passage, which will be the most rearwardly disposed during rotation of the bucket. When so situated, this will provide assurance that this one end of each spanning element 36 will be in contact with cooling liquid as it makes its way along the cooling passage under the influence of the Coriolis force. Proceeding from the radially inward end of airfoil portion 23 in each coolant passage 19 a series of spaced pins 36 are shown in FIG. 3. These pins are shown in parallel relation to each other, but this is not critical. The spacing of these pins is also not critical and may, for example, range from about 3 to about 10 times the inner diameter of the tubes 19. The preferred range of spacings is 4–6 diameters. These spanning elements are preferably of cylindrical configuration, but non-cylindrical, e.g., tapered, configurations may be used. When cylindrical configurations are selected, the cross-section may be circular or non-circular (e.g., square, hexagonal, rhomboid, etc.).

Thus, as liquid coolant enters each tube member 19 and is pulled through this channel by centrifugal force as a thin film, even though a strong Coriolis force acts upon the film and pushes it to the rearwardmost (relative to the direction of rotation) region of the tube 19, the film so constrained must still encounter each spanning element 36 in its outward movement. Contact between the liquid film and each element 38 produces sufficient continuous splashing action to overcome the Coriolis segregation of some of the liquid in the film thereby widening the area of contact between liquid coolant and the inner wall of tube 19 along the length thereof. This results in a significant increase in the effectiveness of the liquid cooling mechanism.

The lateral dimension of the spanning elements 36 (as viewed in FIG. 2) should be small enough so as not to impede the movement of steam along passage 19. Usually one would not want to block more than about 50% of the transverse cross-section of passage 19. In some constructions passages 19 may not be strictly cylindrical in shape, because it may be necessary to bend otherwise cylindrical tubes to conform to bucket contours.

Tests at a series of temperatures ranging from 100° F – 350° F were conducted on a tubular assembly manufactured as follows: first, an annealed 347 stainless steel tube 37 (0.080 inch I.D., 0.010 inch wall thickness was silver plated over its outer surface; second, a length of copper tubing 38 was swaged over the silver-plated, steel tube and the two tubes were then bonded together by firing in a dry hydrogen furnace; next, a series of 0.030 inch diameter holes 39 were drilled completely through this assembly, ½ inch apart and tight-fitting stainless steel pins 36 were inserted through these holes. Finally, the unit so assembled was brazed into a copper block heated by Calrod ® heaters, also embedded in the copper block.

Tests at the same series of temperatures were conducted on a tubular assembly manufactured as follows: first, an annealed 347 stainless steel tube 37 (0.100 inch I.D., 0.010 inch wall thickness) was silver plated over its outer surface; second, a length of copper tubing 38 was swaged over the silver-plated, steel tube and the two tubes were then bonded together by firing in a dry hydrogen furnace; next, a series of 0.040 inch diameter holes 39 were drilled completely through this assembly, ½ inch apart and tight-fitting stainless steel pins 36 were inserted through these holes. Thereafter, a second copper tube 41 was swaged over the preceding assembly and bonded in place so as to approximate a copper-to-copper bond. Finally, the unit so assembled was brazed into a copper block heated by Calrod® heaters, also embedded in the copper block.

In both cases set forth above, the copper block was mounted in a rotating turbine-like environment. During rotation each block was heated with the Calrod® heaters and measurements were made of the temperature of water (the coolant) entering the block to pass through the coolant passage and of the temperature of the copper block. The measurements of the copper block temperatures were co-ordinated with the amount of heat introduced into the copper block. The results of these tests were plotted and compared with tests on identical construction without pins. Extrapolation of these results to higher temperature operation indicates that at the proposed temperature of operation, the cooling effect will be at least about 50% greater.

The use of the aforementioned materials, shapes and sizes are merely illustrative and many variations thereof can readily be prepared by the technician utilizing the teachings set forth herein.

The term "bucket" as used in this specification is intended to include all rotating and stationary turbomachinery blades.

BEST MODE CONTEMPLATED

The preferred spanning element configuration is a cylindrical stainless steel pin of circular cross-section. A series of these pins are affixed with each pin extending substantially diametrically across the given coolant passage in a generally parallel disposition. Spacing employed would be about 5 times the internal diameter of the tube. Each tube is embedded in a copper matrix and the inner surface of the tube is stainless steel.

What we claim as new and desire to secure by Letters Patent of the United States is:

1. In liquid-cooled turbine bucket construction comprising an airfoil-shaped portion, a platform portion and a root portion, wherein said root portion is specifically shaped for engaging a rotor structure for rotation of said bucket in a predetermined planar direction and at least said airfoil-shaped portion has a plurality of subsurface coolant passages extending along the pressure and suction faces thereof, the improvement comprising:

said coolant passages extending spanwise of said airfoil-shaped portion;

a plurality of longitudinally-extending spanning elements affixed within an individual coolant passage, said spanning elements being spaced from adjacent spanning elements with each of said spanning elements having one end thereof affixed in the region of the most trailing portion of said coolant passage at the given station therealong relative to said predetermined planar direction.

2. The improved liquid-cooled turbine bucket as recited in claim 1 wherein each spanning element is a pin having a linearly extending central axis.

3. The improved liquid-cooled turbine bucket as recited in claim 1 wherein the pins are each cylindrical in shape and circular in cross-section.

4. The improved liquid-cooled turbine bucket as recited in claim 1 wherein the root portion is in a dovetailed configuration and the spanning elements extend substantially perpendicular to the surface area of the dovetailed configuration.

5. The improved liquid-cooled turbine bucket as recited in claim 1 wherein each spanning element is substantially parallel to the other spanning elements in the individual passage.

6. The improved liquid-cooled turbine bucket as recited in claim 1 wherein the coolant passages are of substantially circular transverse cross-section.

* * * * *